US005529118A

United States Patent [19]

Nitta

[11] Patent Number: 5,529,118

[45] Date of Patent: Jun. 25, 1996

[54] HEAT EXCHANGE SYSTEM FOR VEHICLES AND HEAT EXCHANGER THEREFOR

[76] Inventor: Minoru Nitta, 2207 Laurel Way, Upland, Calif. 91784

[21] Appl. No.: 317,318

[22] Filed: Oct. 4, 1994

[51] Int. Cl.[6] ..... F28D 1/06

[52] U.S. Cl. ..... 165/148; 165/179; 165/DIG. 448

[58] Field of Search ..... 165/148, 179

[56] References Cited

U.S. PATENT DOCUMENTS

| | | | |
|---|---|---|---|
| 830,423 | 9/1906 | Fernwell | 165/148 |
| 1,301,312 | 4/1919 | Peris | 165/148 |
| 1,313,652 | 8/1919 | Taylor | 165/148 |
| 1,356,676 | 10/1920 | Weller | 165/148 |
| 1,673,409 | 6/1928 | Kelley | 165/148 |
| 2,036,943 | 4/1936 | Hunt et al. | 165/148 |
| 2,244,800 | 6/1941 | Pascale | 165/179 |
| 2,343,868 | 3/1944 | Dykeman et al. | 165/148 X |
| 2,467,668 | 4/1949 | Hallberg | 165/179 X |
| 2,474,467 | 6/1949 | Conley | 165/148 X |
| 2,537,797 | 1/1951 | Simpelaar | 165/179 |

FOREIGN PATENT DOCUMENTS

| | | | |
|---|---|---|---|
| 465236 | 4/1914 | France | 165/148 |

*Primary Examiner*—Allen J. Flanigan
*Attorney, Agent, or Firm*—Lyon & Lyon

[57] ABSTRACT

A heat exchange system for an engine having cooling passages and a heat exchanger. The heat exchanger has a shell side flow of coolant from the cooling system and air flowing through tubes which extend across the shell and are open at both ends to outwardly of the shell. The tubes may have fins on the outer and/or inner surfaces. The tubes may be formed with one of the tube sheets, with the other tube sheet defining rectangular sidewalls and including holes through which the tubes penetrate and are sealed. An inlet and an outlet are diametrically opposed with flow therebetween being regulated through baffling.

16 Claims, 4 Drawing Sheets

HEAT EXCHANGE SYSTEM FOR VEHICLES AND HEAT EXCHANGER THEREFOR

BACKGROUND OF THE INVENTION

The field of the present invention is heat exchanger construction and systems for vehicles.

Heat exchangers have long been employed in vehicles for both cooling of the engine, commonly referred to as radiators, and for heating the passenger compartment, commonly referred to as heater cores. In both systems, tubes are provided for the engine coolant liquid. The tubes are positioned in an open matrix such that air can be forced or naturally flow past the tubes for heat exchange. Fins associated with the tubes, air flow baffles and the like are used to enhance the heat transfer efficiency between the liquid coolant and the air.

Vehicle efficiency has become of significant interest in the light of competition and regulation. The vehicle coolant heat exchange systems impact significantly on that efficiency. The efficiency of both the radiator and the heater core contribute inversely to weight, size, vehicle frontal area and engine temperature stability. Consequently, improving the efficiency of these devices can significantly impact on the overall vehicle efficiency.

SUMMARY OF THE INVENTION

The present invention is directed to heat exchange technology wherein the coolant flows through the shell and the air stream passes through tubes open at both ends outwardly of the shell.

In a first aspect of the present invention, a heat exchange system for a vehicle includes a heat exchanger having a shell which receives the coolant from the system. Tubes extend across the shell and open outwardly for airflow and efficient heat transfer. The tubes may include fins for increased heat transfer.

In a second aspect of the present invention, a heat exchanger structure includes two tube sheets with tubes extending from one of the sheets and extending through holes in the second sheet. The exchanger may additionally include baffles of various configurations. In one configuration, baffles extend inwardly between the tubes from either side to create a circuitous path for coolant through the shell side of the exchanger.

Accordingly, it is an object of the present invention to provide an improved heat exchange system and improved components therefor. Other and further objects and advantages will appear hereinafter.

DETAILED DESCRIPTION OF THE PREFERRED EMBODIMENTS

Figure 1:
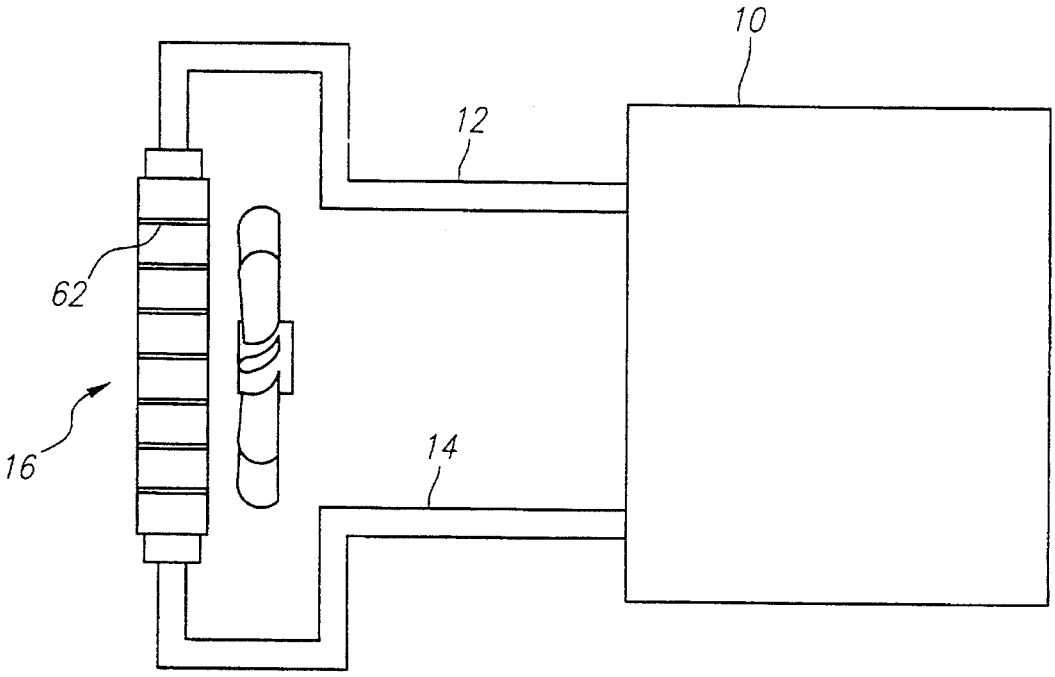
FIG. 1 is a schematic view of a heat exchange system for an engine.

Turning in detail to the drawings, FIG. 1 illustrates a heat exchange system for an engine 10. Cooling passages 12 and are coupled with the cooling system of the engine 10 and are in communication with a heat exchanger, generally designated 16. A fan 18 Schematically illustrates airflow enhancement mechanisms to insure adequate flow through the heat exchanger 16.

Figure 2:
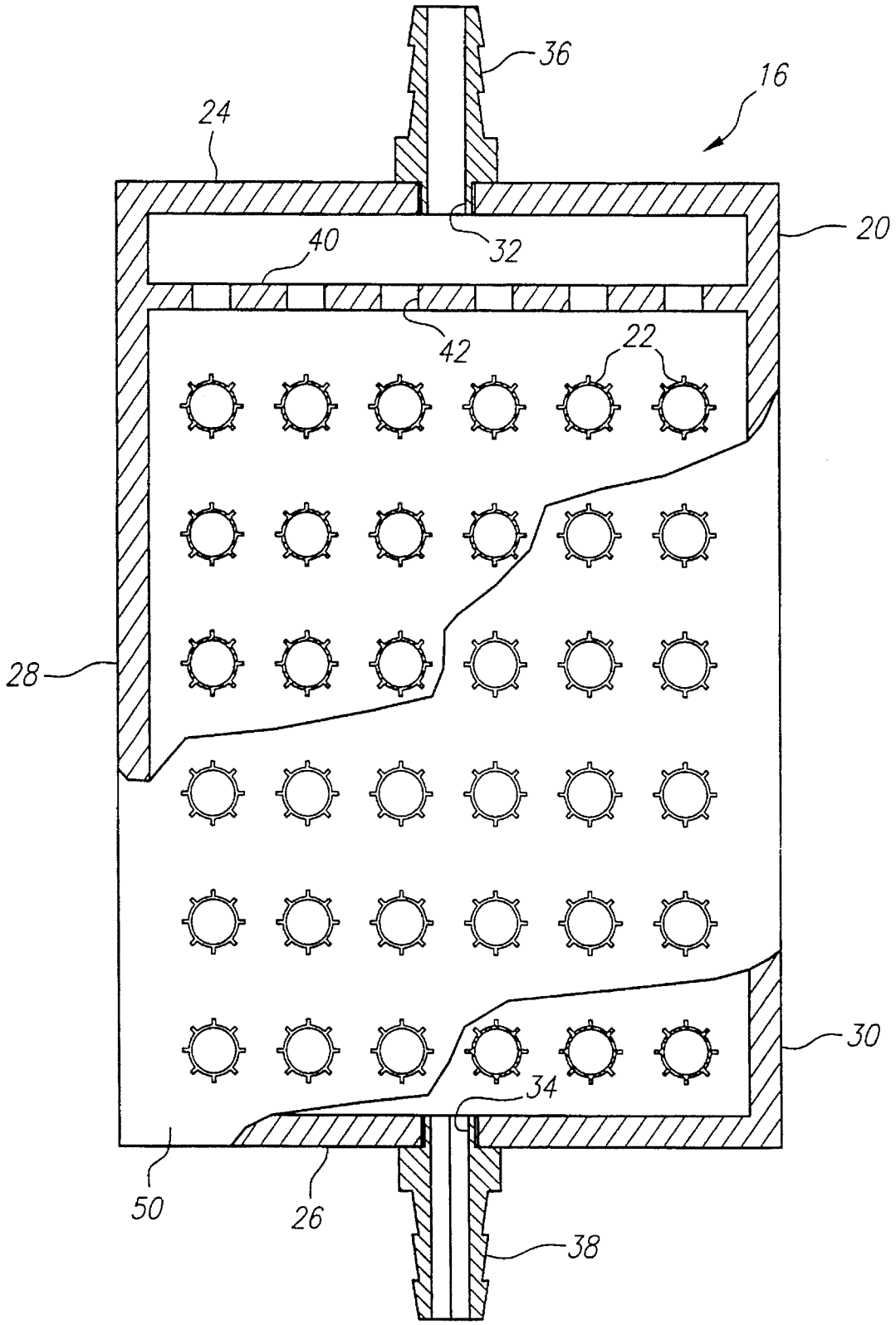
FIG. 2 is a side view of a heat exchanger with portions broken away for clarity.
Figure 3:
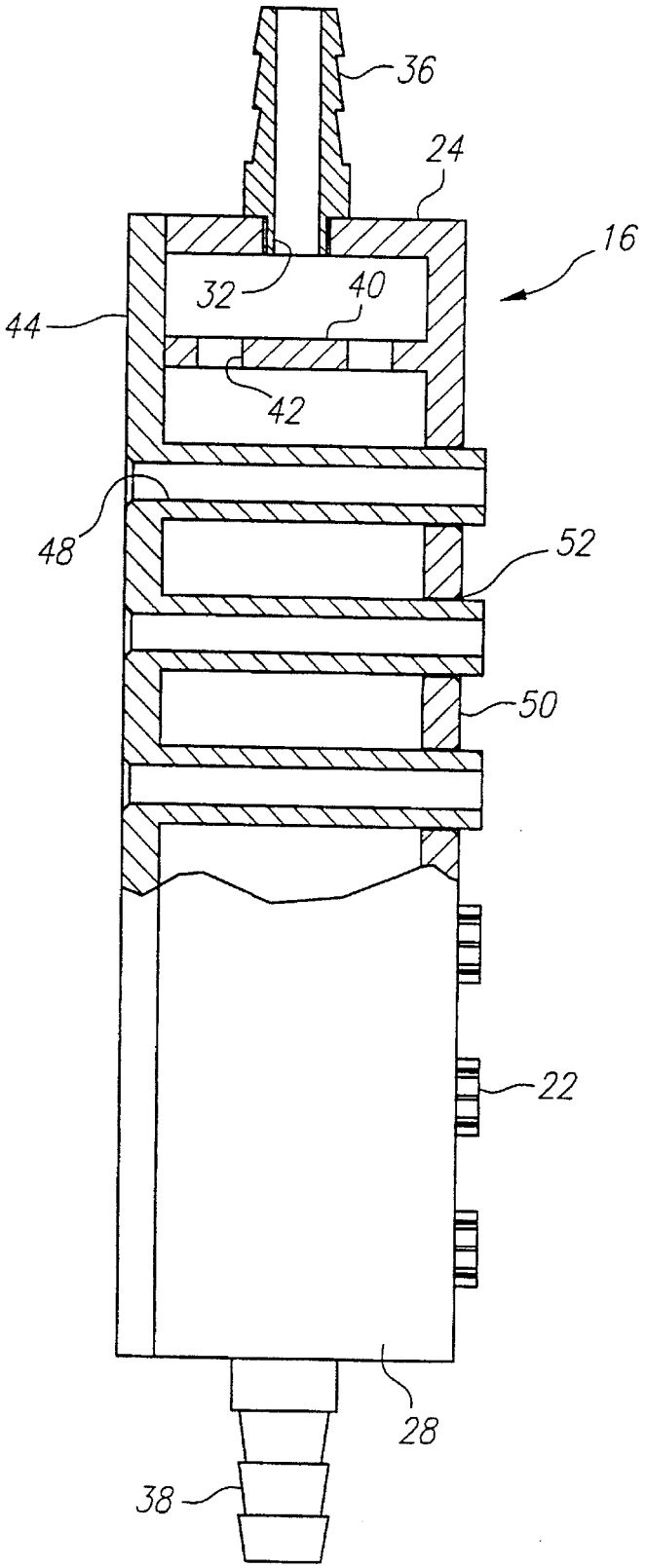
FIG. 3 is a side view of the heat exchanger of FIG. 2 with portions broken away for clarity.

FIG. 2 details a first embodiment of the heat exchanger 16. The heat exchanger 16 includes a shell 20 and a plurality of tubes 22. There are four sidewalls 24, 26, 28 and 30 arranged in a rectangular structure. The upper and lower sidewall is 24 and 26 include an inlet 32 and an outlet 34, respectively. Couplings 36 and 38 may be associated with and become part of the cooling passages 12 and 14. A baffle 40 having holes 42 extends fully across the interior of the shell 20. Thus, flow through the inlet 32 must pass through the holes 42 of the baffle 40 before encountering the tubes 22. Thus, an appropriate distribution of coolant to all tubes 22 may be achieved.

The heat exchanger 16 is constructed of a series of formed elements which may be brazed or otherwise joined together. A first tube sheet 44 is shown to be integrally formed with the tubes 22. Holes 48 extend through the tube sheet to align with the centers of the tubes 22 for communication with the air. A second tube sheet 50 has holes 52 which extend therethrough. The holes are sized to accommodate the tubes 22 such that they may extend at least part of the way through the sheet 50. The tubes 22 may be appropriately brazed or otherwise sealed with the sheet 50. The sheet 50 is formed with the four sidewalls 24, 26, 28 and 30. The first tube sheet 44 abuts against the sidewalls where it may be appropriately sealed through brazing or other means.

Figure 4:
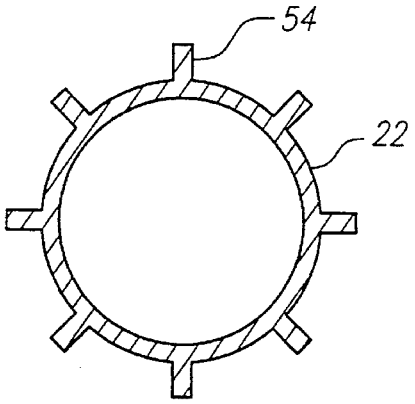
FIG. 4 is a cross section of a first tube configuration.
Figure 5:
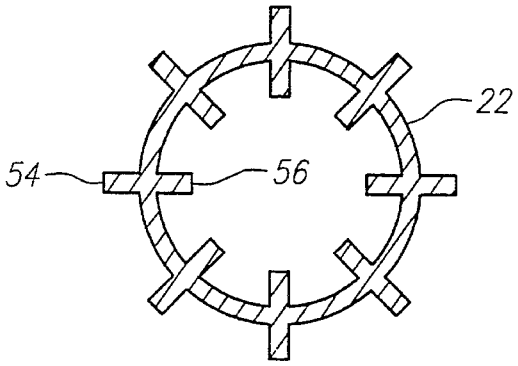
FIG. 5 is a cross section of a second tube configuration.

The tubes may be of various configurations. FIGS. 4 and 5 represent two such configurations. The tubes 22 include longitudinally oriented radially directed fins 54 in the embodiment of FIG. 4. The embodiment of FIG. 5 illustrates additional longitudinally oriented fins 56 which extend radially inwardly.

Figure 6:
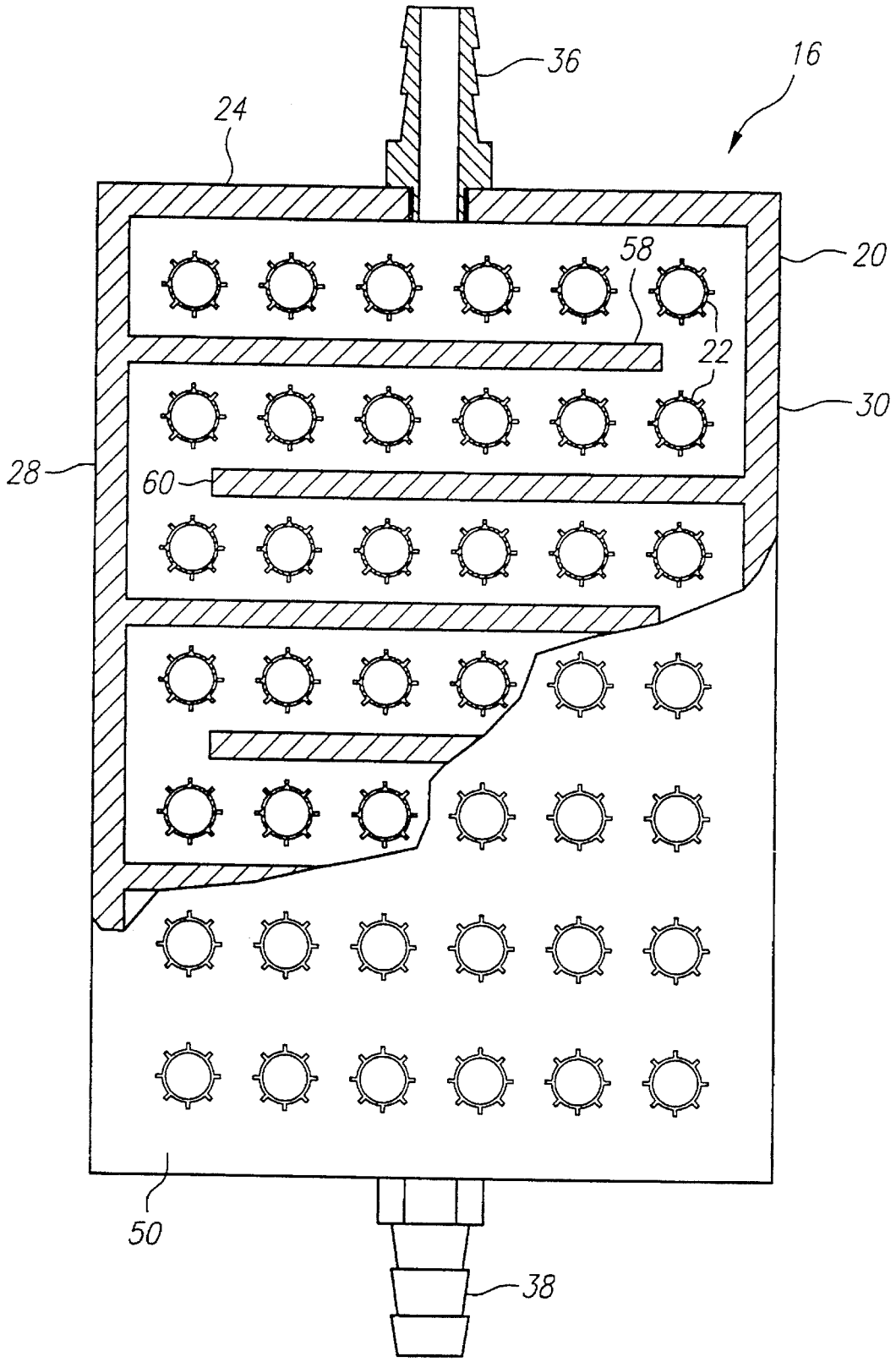
FIG. 6 is a side view of a heat exchanger showing an alternate baffle arrangement with portions broken away for clarity.

A further embodiment is illustrated in FIG. 6. The shell 20 includes baffles 58 and 60 extending inwardly from either of the sidewalls 28 and 30, respectively. The baffles 58 and 60 do not extend fully across the shell and are shown alternate with rows of tubes 22 therebetween. With the baffles 58 and 60 extending fully between the tube sheets 44 and 50, the coolant flow must traverse back and forth through the shell 20. Thus, residence time within the shell is better controlled for the entire flow. It may be further advantageous to locate the inlet 32 and outlet 34 at appropriate corners of the shell 20 so as to obtain maximum advantage of both the uppermost and lowermost rows of tubes 22.

The schematic of FIG. 1 also further illustrates additional cooling mechanisms which may be applied for efficient cooling. Fins 62 may be located on the outer side of the shell 20 for further heat transfer from the exchanger.

Accordingly, an improved heat exchange system with an improved a heat exchanger have been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A heat exchange system for an engine, comprising a coolant circuit including cooling passages in communication with the engine;

a heat exchanger in the coolant circuit and including a shell, an inlet to the shell coupled with a first of the cooling passages, an outlet from the shell coupled with a second of the cooling passages, tubes extending across the shell and open outwardly of the shell at both ends and having shell side longitudinal fins radiating outwardly from the tubes into the shell, each fin extending substantially the length of the tube.

2. The heat exchange system of claim 1, the tubes having tube side longitudinal fins radiating inwardly within the tubes.

3. A heat exchange system for an engine, comprising a coolant circuit including cooling passages in communication with the engine;

a heat exchanger in the coolant circuit and including a shell, an inlet to the shell coupled with a first of the cooling passages, an outlet from the shell coupled with a second of the cooling passages, tubes extending across the shell and open outwardly of the shell at both ends having tube side longitudinal fins radiating inwardly within the tubes, each fill extending substantially the length of the tube.

4. A heat exchange system for an engine, comprising a coolant circuit including cooling passages in communication with the engine;

a heat exchanger in the coolant circuit and including a shell, an inlet to the shell coupled with a first of the cooling passages, an outlet from the shell coupled with a second of the cooling passages, tubes, extending across the shell and open outwardly of the shell at both ends, the shell including a first tube sheet having the tubes extending only in one direction from the inner surface thereof and having first holes therethrough aligned with the tubes and a second tube sheet having second holes therethrough, the tubes extending through the second holes.

5. The heat exchange system of claim 4, the shell further including sidewalls extending between the first tube sheet and the second tube sheet, the inlet being in a first of the sidewalls and the outlet being in a second of the sidewalls opposed to the inlet.

6. A heat exchange system for an engine, comprising a coolant circuit including cooling passages in communication with the engine;

a heat exchanger in the coolant circuit and including a shell, an inlet to the shell coupled with a first of the cooling passages, an outlet from the shell coupled with a second of the cooling passages, tubes extending across the shell and open outwardly of the shell at both ends; and a baffle adjacent the inlet in the shell, the baffle extending fully across the interior of the shell and having holes therethrough.

7. A heat exchange system for an engine, comprising a coolant circuit including cooling passages in communication with the engine;

a heat exchanger in the coolant circuit and including a shell, an inlet to the shell coupled with a first of the cooling passages, an outlet from the shell coupled with a second of the cooling passages, tubes extending across the shell and open outwardly of the shell at both ends, the shell having a first tube sheet, a second tube sheet and sidewalls extending between the first tube sheet and the second tube sheet, the tubes extending between and being open outwardly of the first tube sheet and the second tube sheet, a first one of the sidewalls including first baffles extending inwardly in the shell to between the tubes and not fully across the shell, a second one of the sidewalls including second baffles extending inwardly in the shell to between the tubes and not fully across the shell, the second one of the sidewalls being opposed to the first one of the sidewalls.

8. The heat exchange system of claim 7, there being four sidewalls in rectangular arrangement with a third one of the sidewalls including the inlet and a fourth one of the sidewalls including the outlet.

9. The heat exchange system of claim 7, the first tube sheet having the tubes extending from the inner surface thereof and having first holes therethrough aligned with the tubes and the second tube sheet having second holes therethrough, the tubes extending through the second holes.

10. A heat exchanger comprising:

a shell;

an inlet to the shell;

an outlet from the shell;

tubes extending through the shell and open outwardly of the shell at both ends, the shell including a first tube sheet having the tubes extending only in one direction from the inner surface thereof and having first holes therethrough aligned with the tubes and a second tube sheet having second holes therethrough, the tubes extending through the second holes.

11. The heat exchange system of claim 10, the shell having cooling fins on the outside thereof.

12. The heat exchanger of claim 10, the tubes including fins.

13. The heat exchanger of claim 12, the fins being longitudinally oriented and extending radially of the tubes.

14. The heat exchanger of claim 13, the fins extending outwardly of the tubes into the shell.

15. The heat exchanger of claim 13, the fins extending inwardly of the tubes.

16. The heat exchanger of claim 13, the fins extending both inwardly and outwardly of the tubes.

* * * * *